US005505182A

United States Patent [19]

Denz et al.

[11] Patent Number: 5,505,182

[45] Date of Patent: Apr. 9, 1996

[54] METHOD AND ARRANGEMENT FOR CHECKING A TANK-VENTING SYSTEM

[75] Inventors: Helmut Denz, Stuttgart; Andreas Blumenstock, Ludwigsburg, both of Germany

[73] Assignee: Robert Bosch GmbH, Stuttgart, Germany

[21] Appl. No.: 133,054

[22] PCT Filed: Feb. 21, 1992

[86] PCT No.: PCT/DE92/00129

§ 371 Date: Oct. 12, 1993

§ 102(e) Date: Oct. 12, 1993

[87] PCT Pub. No.: WO92/18764

PCT Pub. Date: Oct. 29, 1992

[30] Foreign Application Priority Data

Apr. 9, 1991 [DE] Germany ..... 41 11 360.8

[51] Int. Cl.[6] ..... F02M 33/02

[52] U.S. Cl. ..... 123/520; 123/198 D

[58] Field of Search ..... 123/520, 521, 123/518, 519, 516, 198 D

[56] References Cited

U.S. PATENT DOCUMENTS

| | | | |
|---|---|---|---|
| 4,867,126 | 9/1989 | Yonekawa | 123/520 |
| 4,887,578 | 12/1989 | Woodcock et al. . | |
| 4,926,825 | 5/1990 | Ohtaka | 123/520 |
| 4,949,695 | 8/1990 | Uranishi et al. . | |
| 4,962,744 | 10/1990 | Uranishi | 123/520 |
| 5,085,194 | 2/1992 | Kuroda | 123/520 |
| 5,085,197 | 2/1992 | Mader | 123/520 |

FOREIGN PATENT DOCUMENTS

| | | |
|---|---|---|
| 2635823 | 3/1990 | France . |
| 4012111 | 3/1991 | Germany . |
| 2-102360 | 4/1990 | Japan . |
| 2130256 | 5/1990 | Japan . |
| WO90/11443 | 10/1990 | WIPO . |
| WO91/12426 | 8/1991 | WIPO . |

*Primary Examiner*—Carl S. Miller
*Attorney, Agent, or Firm*—Walter Ottesen

[57] ABSTRACT

A method for checking the operability of a tank-venting system for a motor vehicle having an internal combustion engine (10), the system including an adsorption filter (14) having a venting opening (17) at its venting end and having a connecting line (16) to a tank (15) as well as a tank-venting valve (13) which is connected into a connecting line (12) between the intake pipe (11) of the engine and the intake end of the adsorption filter, characterized in that:

a difference pressure (Dp) is measured which is a measure for the pressure difference between the venting end and the intake end of the adsorption filter; and, a conclusion is drawn as to inadequate throughput capacity of the adsorption filter when the measured difference pressure exceeds a threshold value (Dp_SW).

With this method, as with similar methods provided in the disclosure, it is possible for the first time to check the throughput capacity of an adsorption filter in a tank-venting system. A tank-venting system can be overall checked better as to operability than previously when this method is used in addition to methods previously known which, for example, check the tightness of the system or the operability of the tank-venting valve.

14 Claims, 4 Drawing Sheets

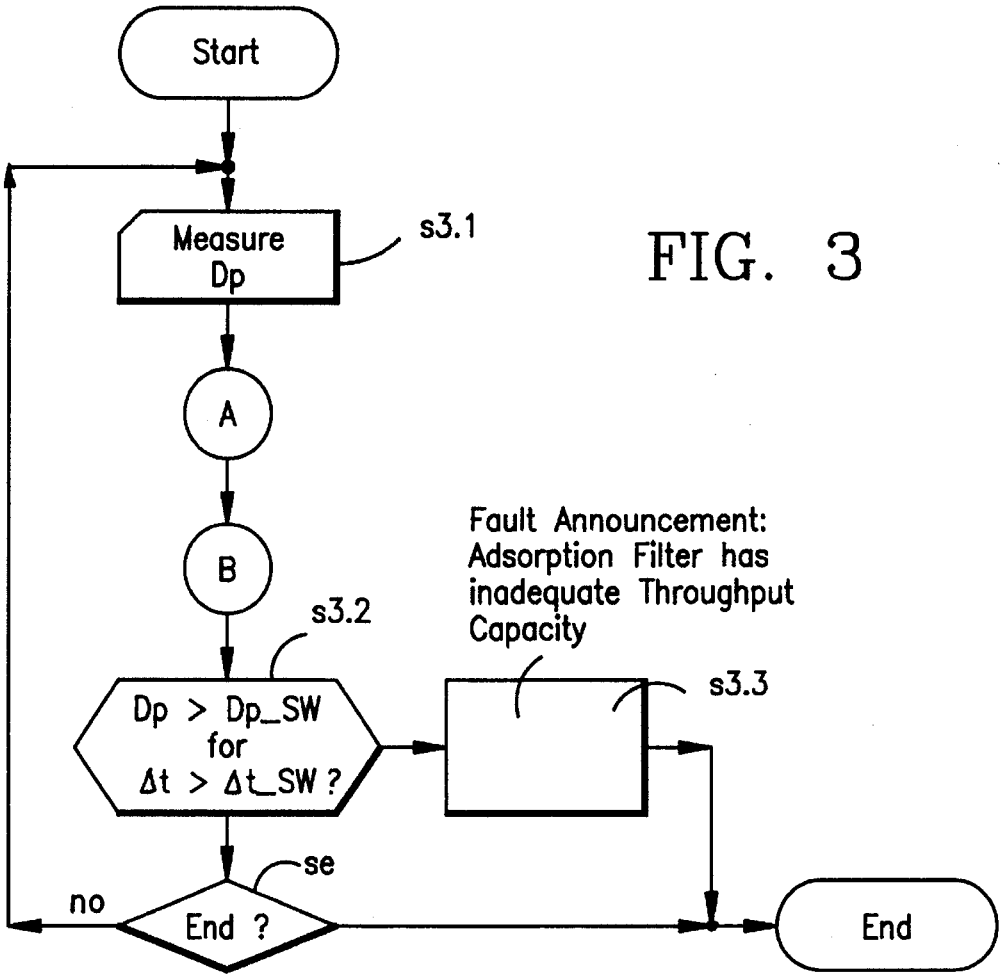
FIG. 3
FIG. 4
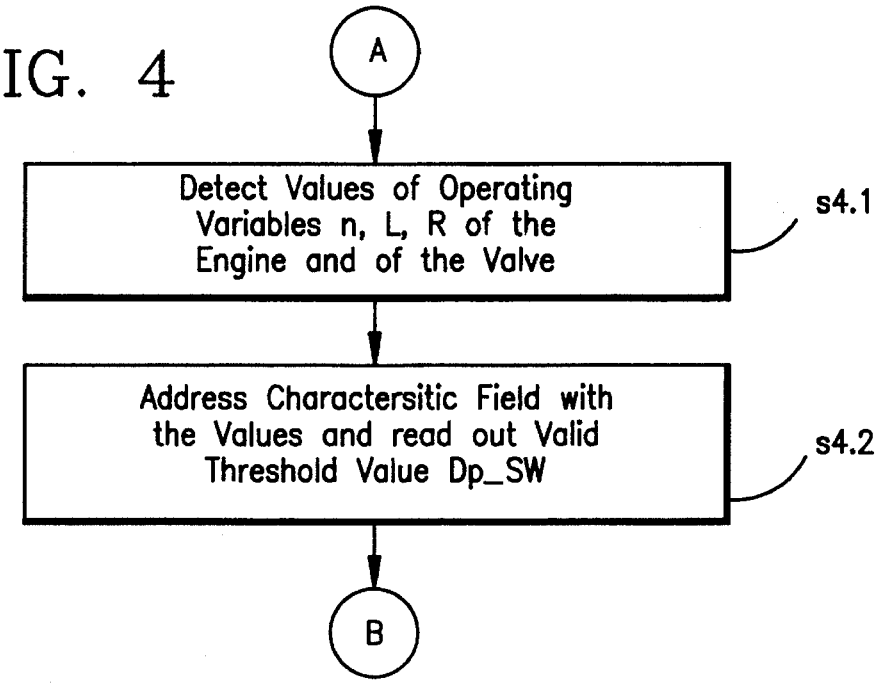

METHOD AND ARRANGEMENT FOR CHECKING A TANK-VENTING SYSTEM

FIELD OF THE INVENTION

The following relates to a method and an arrangement for checking the operability of a tank-venting system for a motor vehicle having an internal combustion engine.

BACKGROUND OF THE INVENTION

Tank-venting systems having the following features are known for a long time:

an adsorption filter having a venting opening at its venting end and a connecting line to the tank;

a tank-venting valve which is connected into a connecting line between the intake pipe of the engine and the intake end of the adsorption filter; and, a drive unit for the tank-venting valve.

The drive unit drives the tank-venting valve in a fixed pregiven time pattern, for example, the drive unit alternately holds the valve closed for 1.5 minutes and then opens the valve for 4 minutes in order to make a regeneration of the adsorption filter possible. The opening cross section of the tank-venting valve is determined via a pulse-duty factor dependent upon the particular operating state of the engine.

It is apparent that tank-venting systems of this kind can only then operate completely satisfactorily when they are tight and when the tank-venting valve opens and closes properly. Various methods are known for checking the tightness and the operability of the tank-venting valve. However, it has been shown that these methods are not adequate in order to satisfactorily consider all aspects with reference to the operability of the tank-venting system.

Accordingly, the problem is present to provide a method and an arrangement with which a tank-venting system can be checked differently than previously with respect to operability.

SUMMARY OF THE INVENTIONS

A first method of the invention for checking the operability of a tank-venting system of the above-mentioned type is characterized in that:

a difference pressure is measured which is a measure for the pressure difference between the venting end and the intake end of the adsorption filter; and, a conclusion is drawn as to inadequate throughput of the adsorption filter when the measured difference pressure exceeds a threshold value.

A second method according to the invention is characterized in that:

the tank-venting valve is closed after a regeneration phase of pregiven duration has run wherein an underpressure has developed in the tank-venting system and a difference pressure (Dp) is measured essentially when closing the tank-venting valve with this difference pressure being a measure for the pressure difference between the venting end and the intake end of the adsorption filter;

the time constant $\tau$ for the decay of the measured pressure difference is determined after closing of the tank-venting valve with the aid of at least one further difference pressure measurement; and, a conclusion is drawn as to inadequate throughput capacity of the adsorption filter when the determined time constant is longer than a threshold value time constant ($\tau$_SW).

A third method according to the invention is for a system which is so configured that, when tanking, the filling nozzle seals tightly against the tank stub (OBVR-system=on-board-vapor-recovery system) and the method is characterized in that:

a determination is made as to whether tanking takes place;

in the event that tanking is determined, the difference overpressure (Dp) is measured which corresponds to the difference between the inner pressure of the tank-venting system and the ambient pressure; and, the tank-venting system is evaluated as being clogged when the measured difference overpressure exceeds a difference overpressure threshold value (Dp>DSP_SW).

These methods investigate the throughput capacity of the system and especially of the adsorption filter as a new aspect of the operability of a tank-venting system. This throughput capacity can, for example, be reduced either in that the venting opening is entirely or partially clogged or in that the charge of the adsorption filter, which as a rule is active charcoal, is so caked or dirtied that the charge greatly hinders the flow of venting air through the filter. In both cases, the adsorption filter can no longer correctly perform its task of adsorbing fuel vapor and desorbing the same with the aid of venting air. The inventions are based on the realization that this defect becomes manifest in that, for a pregiven intake capacity, the underpressure at the intake end is that much greater the less venting air can flow to this end and that, when closing the tank-venting valve, the decay of the above-mentioned underpressure takes place that much slower the slower the venting air (and fuel vapor) flows. Each of these effects, that is, the effect of amplified underpressure and the effect of slowed pressure decay can be applied separately to determine inadequate throughput capacity of the adsorption filter. A further effect is excessive pressure increase when tanking an OBVR-system.

The difference pressure is a measure for the pressure difference between the venting end and the intake end of the adsorption filter. This difference pressure can be measured directly. As a measure for this pressure, it is however simpler to measure the difference between the pressure at the intake end of the adsorption filter and the ambient pressure since then the connection of a difference pressure sensor to the venting end is unnecessary. The pressure measured in this way is an excellent measure for the actual above-mentioned pressure difference since the pressure at the venting end of the adsorption filter corresponds essentially to the ambient pressure. If a tank-venting system has a difference pressure sensor on the tank for any purpose whatsoever, it is advantageous to use the signal of this difference pressure sensor as a measure for the above-mentioned pressure difference.

If only a single value is determined as the threshold value for the difference underpressure, then this value must be selected to be so great that this value can only be exceeded when an operating state with the highest possible underpressure is present at the intake end. Such an operating state is typically one of average load and average rpm of the engine with high gas flow through the adsorption filter. It is possible that such an operating state is not obtained over a longer period of time, for example, when a motor vehicle having a very powerful engine is driven in the city. For this reason, it is advantageous to select the above-mentioned threshold value in dependence upon values of operating variables of the engine and of the tank-venting valve. The corresponding pressure at the intake end of the adsorption filter can be determined on a test stand for a properly operating filter for each operating state of the engine and each pulse-duty factor of the tank-venting valve. For each pressure, a corresponding threshold value can be stored in a characteristic field which is a pregiven percentage or a pregiven pressure difference higher than the pressure difference applicable for proper operation.

A first arrangement according to the invention for checking a tank-venting system of the above-mentioned type is characterized by:

a difference pressure sensor for measuring a difference pressure which is a measure for the pressure difference between the venting end and the intake end of the adsorption filter; and, an evaluation device which receives the signal from the difference pressure sensor and is so configured that it emits a fault signal which indicates inadequate throughput capacity of the adsorption filter when the measured difference pressure exceeds a threshold value.

A second arrangement according to the invention for checking the operability of a tank-venting system of the above-mentioned type is characterized by:

a difference pressure sensor for measuring a difference pressure which is a measure for the pressure difference between the venting end and the intake end of the adsorption filter;

a determination device which receives the signal from the difference pressure sensor and, additionally, a signal which indicates closure of the tank-venting valve and which is so configured that it determines the time constant of the decay of the measured difference pressure after closure of the tank-venting valve with the aid of the difference pressure signal supplied to the determination device; and, an evaluation device which receives the signal from the determination device and which is so configured that it emits a fault signal which indicates inadequate throughput capacity of the adsorption filter when the determined time constant exceeds a threshold value.

A third arrangement according to the invention is for checking the operability of a tank-venting system with this system being of the OBVR-type and is characterized by:

a difference pressure sensor (18.2) for measuring a difference overpressure (Dp) which is a measure for the pressure difference between the inner pressure of the tank-venting system and the ambient pressure;

a determination device (25) for determining whether tanking is taking place; and, an evaluation device which is so configured that it evaluates the tank-venting system as being clogged when, in the case of tanking, the measured difference pressure exceeds a difference overpressure threshold value (Dp>DSP_SW).

BRIEF DESCRIPTION OF THE DRAWINGS

The invention will now be explained with reference to the drawings wherein:

FIG. 3 is a flowchart for explaining a method for checking the throughput capacity of an adsorption filter with the aid of an underpressure difference test;

FIG. 4 is a flowchart for explaining an embodiment of the method of FIG. 3 wherein a pressure-difference threshold value is pregiven in dependence upon values of operating variables;

DESCRIPTION OF THE PREFERRED EMBODIMENTS OF THE INVENTION

Figure 1:
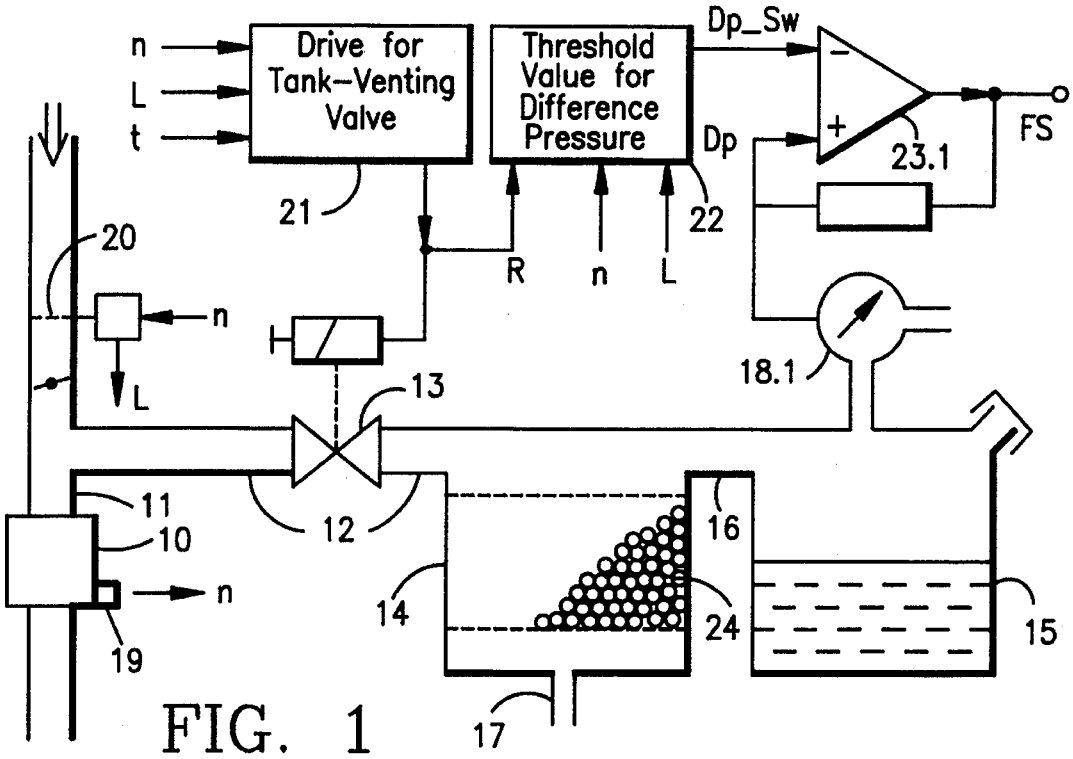
FIG. 1 is a schematic representation of a tank-venting system having an arrangement for checking the throughput capacity of an adsorption filter with the aid of a difference pressure sensor mounted on the tank of the system and a threshold value characteristic field for pressure-difference threshold values.
Figure 2:
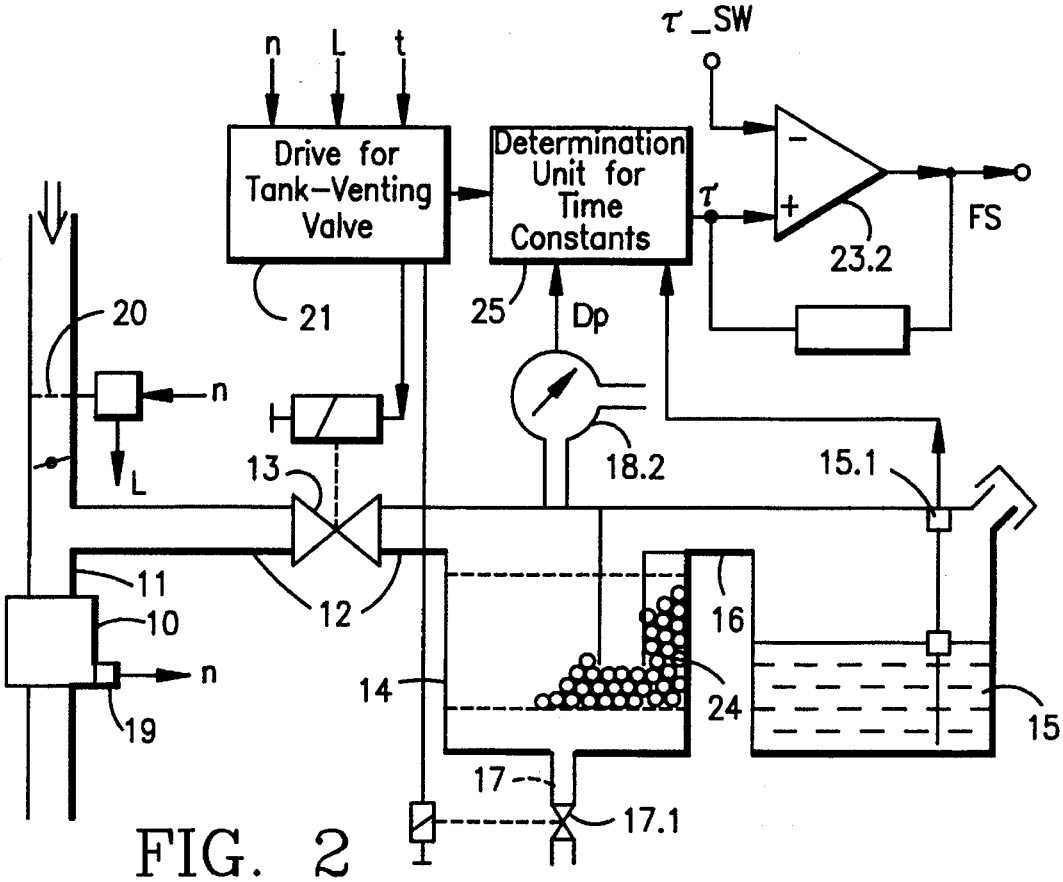
FIG. 2 is an illustration corresponding to FIG. 1 but with a difference pressure sensor on the adsorption in lieu of on the tank and a fixed pregiven time-constant threshold value in lieu of a pressure-difference threshold value from a characteristic field.

The tank-venting system shown in FIG. 1 is on an internal combustion engine having an intake pipe 11 and includes a connecting line 12 with a tank-venting valve 13 arranged between the intake pipe 11 and an adsorption filter 14 as well as a connecting line 16 leading from the adsorption filter to a tank 15. The adsorption filter 14 can also be configured as shown in FIG. 2 which is described below. In the adsorption filter 14, a venting line 17 opens at the venting end of the filter. A difference pressure sensor 18.1 is connected to the tank 15 and measures the difference pressure Dp between the inner pressure of the tank and the ambient pressure.

An rpm sensor 19 is provided on the engine 10 for determining the rpm (n) of the engine. An air-mass sensor 21 is arranged in the intake pipe 11 for detecting the air mass flowing to the engine and supplies a load signal L. The rpm (n) and the load L serve to determine the operating state of the engine 10. The operating state is furthermore dependent upon the time (t) such that an operation takes place with an open or closed tank-venting valve in a fixed time pattern.

For the operation with or without tank venting, the tank-venting valve 13 is so driven in a known manner by a drive unit 21 that for each operating state of the engine, a corresponding pulse-duty factor R of the valve is adjusted.

It is now assumed that the fuel in the tank 15 does not vaporize. If the tank-venting valve 13 is opened under this precondition, a constant difference pressure Dp adjusts in the tank after several seconds and is dependent upon the underpressure in the intake pipe 11, the pulse-duty factor R of the tank-venting valve 13, the characteristic of the tank-venting valve and the throughput capacity of the adsorption filter 14 for venting air. This difference pressure Dp can be determined on a test stand in dependence upon different values of the rpm (n), the load L and the pulse-duty factor R. Each value determined in this way is increased, for example, by 20% and the value increased in this manner is stored as a threshold value for a particular operating state in a threshold value characteristic field 22 and is addressable via values of the above-mentioned operating state variables. From this characteristic field, a particular pressure difference threshold value Dp_SW can be read out again during operation of the tank-venting system and be compared to the current measured difference pressure Dp in a comparator 23.1.

As soon as the throughput capacity of the adsorption filter 14 deteriorates, the pressure difference Dp increases above values as they had been determined on the test stand for a proper filter when the fuel in the tank 15 is not vaporizing. It does not matter whether this deterioration occurs because of a complete or partial clogging of the venting line 17 or because of a caking or dirtying of the active charcoal charge 24 in the adsorption filter 14. As long as the fuel in the tank vaporizes intensely during operation of the system, the above-mentioned current difference-pressure threshold value Dp_SW is not exceeded notwithstanding the deterioration of the throughput capacity of the adsorption filter.

The above just-mentioned case of not exceeding the current difference-pressure threshold value occurs as soon as the fuel no longer vaporizes adequately in order to compensate for the reduced flow of venting air. The comparator 23 then emits a fault signal FS which indicates that the difference pressure Dp has increased above the current threshold value Dp_SW. This fault signal indicates that the adsorption filter has dropped below a pregiven minimum value for the throughput capacity of the venting air.

The threshold-value characteristic field 22 can be omitted when the tank-venting system and the engine corresponding thereto are so designed that operating states with high vapor throughput through the adsorption filter and therefore a high difference pressure Dp occur relatively often. It is then adequate to provide a single high pressure difference threshold value. This is especially the case for systems for engines of low power since these systems are often operated at mean rpms and at mean to upper load ranges for which operating states especially high underpressures occur between intake end and venting end of the adsorption filter.

The comparator 23.1 is used as a device for evaluating the throughput capacity of the adsorption filter 14 and can be further configured so that it does not immediately emit the fault signal FS when the current difference pressure increases above the difference-pressure threshold value; instead, the comparator is so configured that it emits the fault signal only when the difference pressure lies above the corresponding threshold value for at least a pregiven time span. This time condition can, for example, be satisfied in that the difference pressure signal is integrated with a pregiven time constant ahead of the comparison to the threshold value. Considering a certain time span, within which the difference pressure Dp must lie above the pregiven threshold value so that the fault signal FS is emitted, has as its purpose the prevention of the incorrect emission of faults as they can occur when a volume of gas, which communicates with a differential-pressure sensor 18.1, during intense movements of fuel is closed with respect to other lines and this volume increases with the above-mentioned movement of the contents of the tank.

The tank-venting system of FIG. 2 with an arrangement for checking the throughput capacity of an adsorption filter is configured similarly to the system with the above-mentioned checking device of FIG. 1. In FIG. 2, a difference pressure sensor 18.2 is connected to the intake end of the adsorption filter 14 and no longer to the tank 15. However, the pressure difference sensor 18.2 could also be mounted as shown in FIG. 1. In addition, the connecting line 16 from the tank into the adsorption filter no longer opens directly into the adsorption filter at the intake end thereof; rather, it plunges quite deeply into active charcoal charge 14 of the filter. The intake line 16 can, however, also be configured as shown in FIG. 1. A shut-off valve 17.1 for the venting line and a fill-level sensor 15.1 are provided. With respect to the arrangement for checking the throughput capacity of the adsorption filter, it is noted that a comparator 23.2 is present which now receives a fixed time constant threshold value τ_SW from a characteristic field in lieu of a pressure difference threshold value in order to compare this fixed time constant threshold value to a current time constant τ as it is supplied from a determination unit 25. τ_SW can be a fixed value or be dependent from the signal of the level sensor in such a manner that it increases with decreasing tank level.

The determination unit 25 receives the following: the difference pressure signal Dp from the difference pressure sensor 18.2, the fill-level signal and furthermore a signal from the drive 21 for the tank-venting valve. This signal indicates when the tank-venting valve 13 is closed (and the shut-off valve, as in the illustrated embodiment, is opened at the same time). Starting at this closure time point, the determination unit 25 detects values of the difference pressure Dp in pregiven time intervals and determines therefrom the time constant τ for the decay of the difference pressure Dp. In a simple manner, it is also possible that the determination unit 25 is so configured that it measures the time span within which the difference pressure Dp has reached a pregiven value, for example, approximately one-quarter of the difference pressure present at the time point of the closure of the tank-venting valve. This measured time span is then evaluated as a time constant. The shut-off valve 17.1 can, if it is present, be used for the purpose that, to start the test, a larger underpressure is present and in this way a more precise measurement is possible because of an improved signal/noise ratio.

Figure 5:
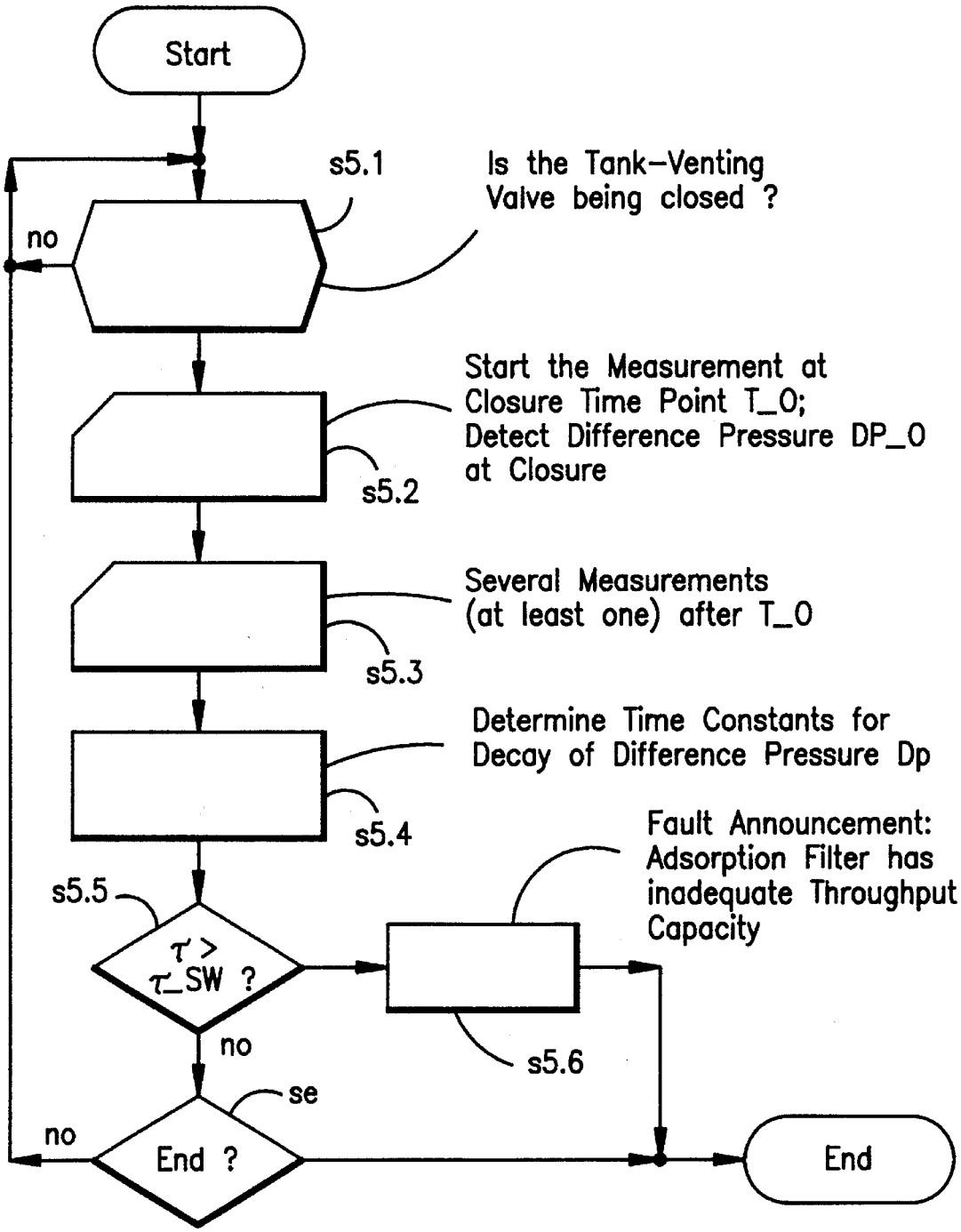
FIG. 5 is a flowchart for explaining a method for checking the throughput capacity of an adsorption filter with the aid of a time constant which describes the decay of the pressure difference between venting end and intake end of the adsorption filter; and, FIG. 6 is a flowchart for explaining a method for checking the throughput capacity of an OBVR-tank-venting system with the aid of an overpressure difference check.

The flowcharts of FIGS. 3 to 5 provide a more precise description of the methods indicated above and additional methods.

In the sequence of FIG. 3, and after the start of the method, the pressure difference Dp is measured (step s3.1) and thereafter, and after running through two marks A and B, a check is made in step s3.2 as to whether the measured pressure difference Dp lies above a threshold value Dp_SW for a time span Δp which is longer than a threshold time span Δp_ SW. If this is not the case, then, in an end step se, a check is made as to whether the method should be ended. If this is not the case, then the operations run again starting with step s3.1. If during one of these runthroughs, it is determined in step s3.2 that the conditions interrogated there are both satisfied, a fault announcement is emitted in a step s3.3 that the adsorption filter shows inadequate throughput capacity. In response to this signal, for example a signal light can be caused to illuminate which indicates that no serious fault is present but that a service station should be visited soon. At the same time, the fault announcement can be stored in a fault memory so that the service station can quickly determine in the context of a fault diagnosis why the signal lamp was caused to illuminate. The end of the method is reached after emission of the fault announcement.

FIG. 4 explains the case illustrated by the arrangement shown in FIG. 1, namely, that the pressure difference threshold value Dp_SW is not pregiven as fixed in step s 3.2 in the method of FIG. 3; instead, the pressure difference threshold value Dp_SW is dependent upon operating variables of the engine and of the tank-venting valve. The steps s4.1 and s4.2 of FIG. 4 are for this purpose inserted between the marks A and B in the method of FIG. 3. In step s4.1, values of operating variables of the engine and of the tank-venting valve are detected. In the embodiment, these operating variables are the rpm n, the load L and the pulse-duty factor R. With the aid of these values, a characteristic field is addressed in step s4.2 from which the current threshold value Dp_SW, which has been read in at the addressed position, is read out.

FIG. 5 shows a method corresponding to that as it is explained with respect to the arrangement of FIG. 2. In a step s5.1, a check is made as to whether the tank-venting valve has been closed. As soon as this is the case, a time measurement is started beginning at closure time point T_0 and the pressure difference Dp_0 at the closure of the valve is detected (step s5.2). Further measurements of the difference pressure Dp take place at fixed time points T after the closure time point T_0 (step s5.3). With the aid of the pressure difference values obtained in this manner in dependence upon the time, the time constant $\tau$ for the decay of the difference pressure Dp is determined (step s5.4).

In a step s5.5, an inquiry is made as to whether the time span $\tau$ determined in this manner is greater than the threshold $\tau$_SW. If this is the case, a measure for making a fault output takes place in a step s5.6. This measure corresponds to that which was explained above with respect to step s3.3 whereupon the method is ended. If in contrast, the result occurs in step s5.5 that the time constant $\tau$ does not exceed the above-mentioned threshold, then an inquiry is made in an end step se as to whether the method should be ended. If this is not the case, then the sequence is carried out anew starting with step s5.1.

In the method sequences just described, it was not provided whether the pressure difference Dp is measured at the tank 15 or at the adsorption filter 14. It is also not explained how the connecting line 16 is introduced into the adsorption filter 14. As mentioned above in another context, the location of the detection of the difference pressure, which is a measure for the pressure difference between the venting end and the intake end of the adsorption filter, that this location in the same manner as the optimal method sequence, is dependent upon the overall configuration of the system and of the engine which coacts with this system. The particular optimal solution can be determined by test stand experiments.

Figure 6:
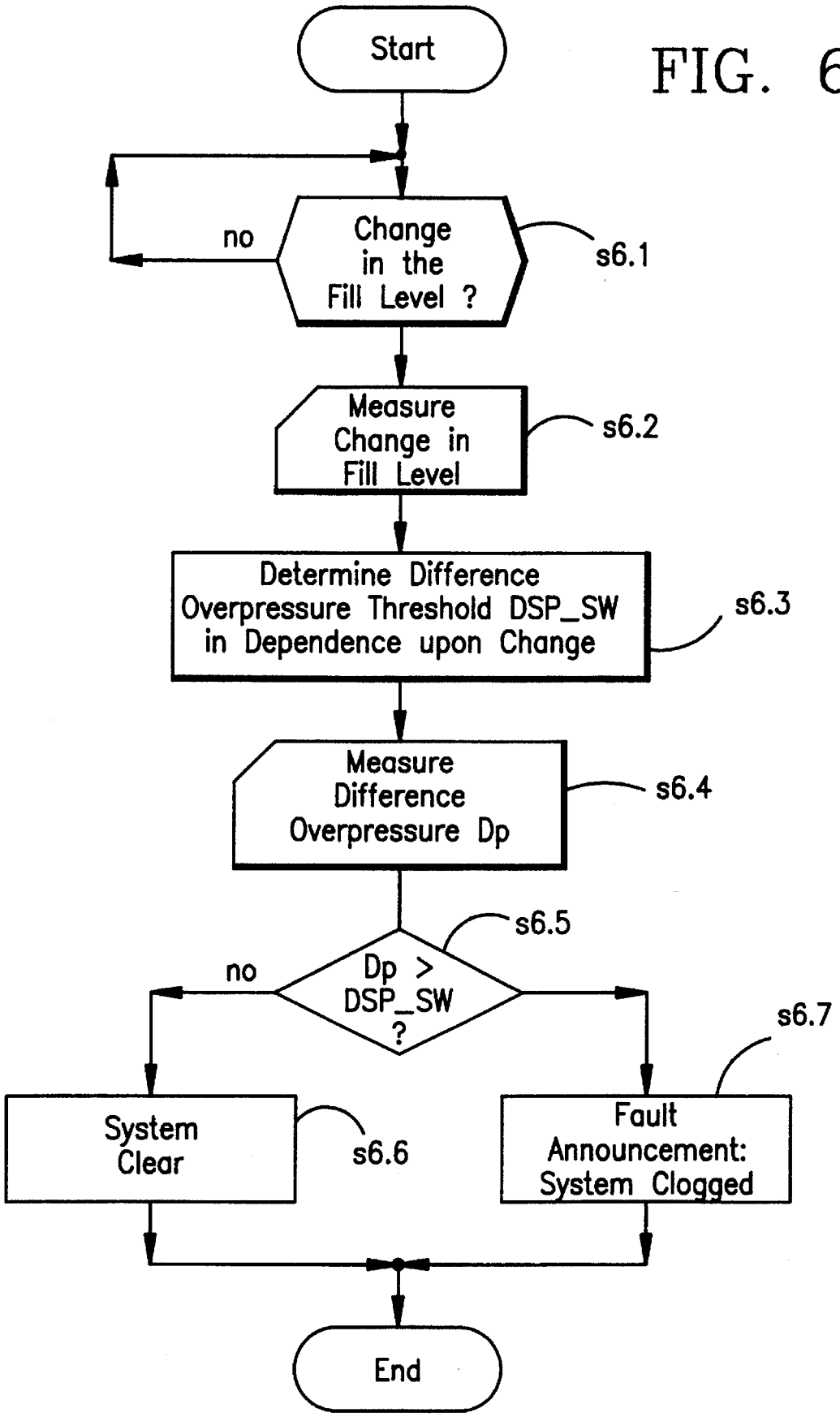

The method according to FIG. 6 is provided for checking the presence of clogging of an OBVR-tank-venting system and especially the clogging of the adsorption filter of such a system. OBVR-systems are systems in which all fuel vapors produced during tanking are to be adsorbed by the adsorption filter (OBVR=On-Board-Vapor-Recovery). This takes place in that when tanking, the fill nozzle is sealed against the tank stub. If the system is clogged, an especially high overpressure must occur during tanking because of the above-mentioned seal. The overpressure is, in its extent, not only dependent upon the extent of the clogging but also on the rapidity with which tanking takes place.

In a step s6.1, a check is made as to whether the fill level in the tank changes. This step serves to determine whether the vehicle is being tanked. If another sensor is provided for this purpose, then this signal can also be used. If tanking is determined, the fill-level change is measured (step s6.2) and a difference overpressure threshold DSP_ SW is determined (step s6.3) with the aid of the measuring result. If a fixed threshold is used, then the steps s6.2 and s6.3 are unnecessary. Thereafter, the difference overpressure Dp is measured (step s6.4) and the measured value is compared to the above-mentioned threshold DSP_SW (step s6.5). If now the measured value does not exceed the threshold value, then the system is evaluated as being free (step s6.6). Otherwise, a fault announcement is outputted (step s6.7) which indicates that the system is clogged. This announcement can be read into a fault memory. In addition, a warning lamp can be caused to illuminate in order to indicate to a driver that a service station must be visited.

The difference overpressure Dp measured in step s6.4 is the pressure difference between the inner pressure of the tank-venting system and the ambient pressure. If the difference pressure sensor for detecting this difference pressure is mounted on the tank as shown in FIG. 1, then all cloggings between the tank and the venting line of the adsorption filter can be determined directly by means of an excessive overpressure. By mounting on the adsorption filter as shown in FIG. 2, blockages of the adsorption filter become noticeable because of excessive higher pressure and blockages between the tank and adsorption filter become noticeable because of the especially low overpressure when tanking.

We claim:

1. A method for checking the operability of a tank-venting system for a motor vehicle having an internal combustion engine, the system including an adsorption filter having a venting opening at its venting end and having a connecting line to a tank as well as a tank-venting valve which is connected into a connecting line between the intake pipe of the engine and the intake end of the adsorption filter, the method comprising the steps of:

measuring a difference pressure (Dp) which is a measure for the pressure difference between the venting end and the intake end of the adsorption filter; and, drawing a conclusion as to inadequate throughput capacity of the adsorption filter when the measured difference pressure (Dp) exceeds the threshold value (Dp_SW) for at least a pregiven time span ($\Delta$t _SW).

2. The method of claim 1, comprising the further steps of:

detecting operating state variables (n, L, R) of the engine and of the tank-venting valve; and, presetting the threshold value (Dp_SW) in dependence upon the detected values of the operating state variables.

3. The method of claim 2, comprising the further step of measuring the difference between the pressure at the intake end of the adsorption filter and the ambient pressure as the difference pressure (Dp).

4. The method of claim 2, comprising the further step of measuring the difference between the pressure in the tank and the ambient pressure as the difference pressure (Dp).

5. A method for checking the operability of a tank-venting system for a motor vehicle having an internal combustion engine, the system including an adsorption filter with a venting opening at its venting end and with a connecting line to a tank as well as a tank-venting valve which is connected into a connecting line between the intake pipe of the engine and the intake end of the adsorption filter, the method comprising the steps of:

allowing a regeneration phase of a pregiven duration to run in which an underpressure has developed in the tank-venting system;

then closing the tank-venting valve and measuring a difference pressure (Dp) essentially during closure which is a measure for the pressure difference between the venting end and the intake end of the adsorption filter;

determining the time constant ($\tau$) for the decay of the measured pressure difference after the closure of the tank-venting valve and making at least one further difference pressure measurement; and, drawing a conclusion as to inadequate throughput capacity of the adsorption filter when the determined time constant is longer than a threshold value time constant ($\tau$_SW).

6. The method of claim 5, wherein the threshold value time constant ($\tau$_SW) is preset in dependence upon the fill level of the tank.

7. The method of claim 6, comprising the further step of measuring the difference between the pressure at the intake end of the adsorption filter and the ambient pressure as the difference pressure (Dp).

8. The method of claim 6, comprising the further step of measuring the difference between the pressure in the tank and the ambient pressure as the difference pressure (Dp).

9. A method for checking the operability of a tank-venting system for a motor vehicle having an internal combustion engine, the system having an adsorption filter and being an on board vapor recovery system wherein all fuel vapors produced during tanking are adsorbed by the adsorption filter and the system, the adsorption filter having a venting opening at its venting end and the system having a connecting line to a tank as well as a tank-venting valve which is connected into a connecting line between the intake pipe of the engine and the intake end of the adsorption filter, the method comprising the steps of:

providing a tank stub and a fill nozzle which conjointly define a seal when tanking;

determining whether the tank is being filled;

if tanking is determined, measuring the difference overpressure (Dp) which corresponds to the difference between the inner pressure of the tank-venting system and the ambient pressure; and, evaluating the tank-venting system as being clogged when the measured difference overpressure (Dp) exceeds a difference overpressure threshold value (DPS_SW).

10. A method for checking the operability of a tank-venting system for a motor vehicle having an internal combustion engine, the system having an adsorption filter with a venting opening at its venting end and with a connecting line to a tank as well as a tank-venting valve which is connected into a connecting line between the intake pipe of the engine and the intake end of the adsorption filter, the system being so configured that when tanking, the fill nozzle is sealed against the tank stub, the method comprising the steps of:

determining whether the tank is being filled;

if tanking is determined, measuring the difference overpressure (Dp) which corresponds to the difference between the inner pressure of the tank-venting system and the ambient pressure; and, evaluating the tank-venting system as being clogged when the measured difference overpressure (Dp) exceeds a difference overpressure threshold value (DSP_SW) which is dependent upon the change of the fill level signal.

11. An arrangement for checking the operability of a tank-venting system for a motor vehicle having an internal combustion engine, the system including an adsorption filter with a venting opening at its venting end and with a connecting line to a tank as well as a tank-venting valve, which is connected into a connecting line between the intake pipe of the engine and the intake end of the adsorption filter, the adsorption filter having an adsorption charge between said venting opening and said intake end, the arrangement comprising:

a difference pressure sensor for measuring a difference pressure (Dp) which is a measure for the pressure difference across said adsorption charge and between the venting end and the intake end of the adsorption filter; and, evaluation means for receiving the signal from the difference pressure sensor and for outputting a fault signal (FS), which indicates inadequate throughput capacity of the adsorption filter, when the measured difference pressure (DP) exceeds a threshold value (Dp_SW).

12. An arrangement for checking the operability of a tank-venting system for a motor vehicle having an internal combustion engine, the system including an adsorption filter with a venting opening at its venting end and having a connecting line to a tank as well as a tank-venting valve, which is connected into a connecting line between the intake pipe of the engine and the intake end of the adsorption filter, the arrangement comprising:

a difference pressure sensor for measuring a difference pressure (Dp), which is a measure for the pressure difference between the venting end and the intake end of the adsorption filter;

determination means for receiving the signal from the difference pressure sensor and a signal which indicates closure of the tank-venting valve and for determining the time constant ($\tau$) of the decay of the measured difference pressure after the closure of the tank-venting valve with the aid of said difference pressure signal supplied thereto; and, evaluation means for receiving the signal of said determination unit and for outputting a fault signal (FS), which indicates inadequate throughput capacity of the adsorption filter, when the determined time constant exceeds a threshold value ($\tau$_SW).

13. An arrangement for checking the operability of a tank-venting system for a motor vehicle having an internal combustion engine, the system including an adsorption filter with a venting opening at its venting end and having a connecting line to a tank as well as a tank-venting valve, the tank-venting valve being connected into a connecting line between the intake pipe of the engine and the intake end of the adsorption filter, the system being so configured that, when tanking, the fill nozzle is sealed tight against the tank stub, the arrangement comprising:

a difference pressure sensor for measuring a difference overpressure (Dp) which is a measure for the pressure difference between the inner pressure of the tank-venting system and the ambient pressure;

determination means for determining whether tanking is taking place; and, evaluation means for evaluating the tank-venting system as being clogged when, in the case of tanking, the measured difference overpressure (DP) exceeds a difference overpressure threshold value (DSP_SW).

14. A method for checking the operability of a tank-venting system for a motor vehicle having an internal combustion engine, the system including an adsorption filter having a venting opening at atmospheric pressure at its venting end and having a connecting line to a tank as well as a tank-venting valve which is connected into a connecting line between the intake pipe of the engine and the intake end of the adsorption filter, the adsorption filter having an adsorption charge between said venting opening and said intake end, the method comprising the steps of:

measuring a difference pressure (Dp) across said adsorption charge between the venting end and the intake end of the adsorption filter; and, drawing a conclusion as to inadequate throughput capacity of the adsorption filter when the measured difference pressure (Dp) exceeds a threshold value (Dp_SW).

* * * * *